US012704274B2

(12) United States Patent
van Hassel

(10) Patent No.: US 12,704,274 B2
(45) Date of Patent: Aug. 11, 2026

(54) LIQUID DESICCANT DEDICATED VAPOR COMPRESSION SYSTEM AND A METHOD OF OPERATION THEREOF

(71) Applicant: Carrier Corporation, Palm Beach Gardens,, FL (US)

(72) Inventor: Bart van Hassel, Weatogue, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 130 days.

(21) Appl. No.: 18/738,094

(22) Filed: Jun. 10, 2024

(65) Prior Publication Data

US 2024/0418379 A1 Dec. 19, 2024

Related U.S. Application Data

(60) Provisional application No. 63/508,976, filed on Jun. 19, 2023.

(51) Int. Cl.
*F24F 3/14* (2006.01)
*F24F 1/0083* (2019.01)

(52) U.S. Cl.
CPC ..... *F24F 3/1417* (2013.01); *F24F 1/0083* (2019.02)

(58) Field of Classification Search
CPC .. F24F 3/1417; F24F 1/0083; B01D 53/1425; B01D 53/263; F25B 17/02; F25B 2400/16; F25B 41/30
See application file for complete search history.

(56) References Cited

U.S. PATENT DOCUMENTS 4,941,324 A 7/1990 Peterson et al.
5,097,668 A 3/1992 Albers et al.
(Continued)

FOREIGN PATENT DOCUMENTS

GB 2552239 B 8/2022

OTHER PUBLICATIONS

Ail Research, Inc., "Compressor Based Liquid Desiccant Air Conditioner", retrieved from http://ailr.com/our-technology/lddx-compressor-based-liquid-desiccant-air-conditioner/, 2024, 5 Pages.
Chen et al. , "Recent progress in liquid desiccant dehumidification and air-conditioning: A review", Energy and Built Environment, vol. 1, Issue 1, Jan. 2020, pp. 106-130, 25 pages, journal homepage: www.elsevier.com/locate/enbenv.
(Continued)

*Primary Examiner* — Jerry-Daryl Fletcher
*Assistant Examiner* — Dario Antonio Deleon
(74) *Attorney, Agent, or Firm* — Drew Folgmann

(57) ABSTRACT

A liquid desiccant dedicated vapor compression system is disclosed. The system comprises an evaporator fluidically connected to a condenser through a compressor, an absorber fluidically connected to the evaporator to facilitate flow of air through the evaporator and the absorber, and a desorber fluidically connected to the absorber to facilitate the flow of the desiccant solution therebetween and further fluidically connected to the condenser to facilitate the flow of air through the condenser and the desorber. An inlet of a first refrigerant tube associated with the absorber, and an inlet of evaporator coils associated with the evaporator are fluidically connected to an outlet of the condenser via two different expansion valves. Further, an inlet of a second refrigerant tube associated with a desorber and an inlet of condenser coils associated with the condenser are fluidically connected to an outlet of the compressor.

14 Claims, 4 Drawing Sheets

(56) References Cited

U.S. PATENT DOCUMENTS

| | | | | |
|---|---|---|---|---|
| 5,191,771 | A | 3/1993 | Meckler | |
| 5,471,852 | A | 12/1995 | Meckler | |
| 6,134,903 | A | 10/2000 | Potnis et al. | |
| 6,976,365 | B2 | 12/2005 | Forkosh et al. | |
| 7,306,650 | B2 | 12/2007 | Slayzak et al. | |
| 7,905,107 | B2 | 3/2011 | Forkosh et al. | |
| 8,268,060 | B2 | 9/2012 | Hargis et al. | |
| 8,696,805 | B2 | 4/2014 | Chang et al. | |
| 9,101,874 | B2 | 8/2015 | Vandermeulen | |
| 9,423,140 | B2 | 8/2016 | Betts et al. | |
| 9,511,322 | B2 | 12/2016 | Ranjan et al. | |
| 10,386,084 | B2 | 8/2019 | Bahar et al. | |
| 10,619,895 | B1 | 4/2020 | Vandermeulen | |
| 10,655,870 | B2 | 5/2020 | Lowenstein | |
| 11,149,970 | B2 | 10/2021 | Bahar et al. | |
| 11,326,790 | B2 | 5/2022 | Woods et al. | |
| 12,188,681 | B2 * | 1/2025 | Alhorr | F24F 5/0035 |
| 2014/0238057 | A1 | 8/2014 | Kandil et al. | |
| 2016/0123610 | A1 * | 5/2016 | Uselton | F24F 3/1417 62/94 |
| 2017/0241654 | A1 * | 8/2017 | Lowenstein | F24F 3/1429 |
| 2024/0337393 | A1 * | 10/2024 | Farese et al. | F24F 3/1429 |

OTHER PUBLICATIONS

Extended European Search Report received for EP Application No. 24183173.4, mailed on Mar. 24, 2025, 10 Pages.

Kumar et al., "Comparative Analysis on Dehumidification Performance of KCOOH-LiCl Hybrid Liquid Desiccant Air-Conditioning System: An Energy-Saving Approach", Sustainability, MDPI, vol. 14, Issue 6, 2022, 22 pages, Basel, Switzerland, https://www.mdpi.com/journal/sustainability.

Lowenstein, Andrew, "Review of Liquid Desiccant Technology for HVAC Applications", HVAC&R Research, vol. 14, No. 6, Nov. 2008, pp. 819-839, Princeton, New Jersey.

Mohan et al., "Experimental investigations on performance of liquid desiccant-vapor compression hybrid air conditioner", Applied Thermal Engineering, vol. 77, Feb. 25, 2015, pp. 153-162, Chennai India.

Zapka, Manfred J. et al., Hawaii Energy and Environmental Technologies (HEET) Initiative, Office of Naval Research, Grant Award No. N0014-11-1-0391, "Assessment of Desiccant Dehumidification: Literature and Technology Review", Prepared by: Sustainable Design & Consulting LLC, Prepared for: University of Hawaii at Manoa, Hawaii Natural Energy Institute Jul. 2016, p. 146 of 171, Honolulu, Hawaii.

* cited by examiner

LIQUID DESICCANT DEDICATED VAPOR COMPRESSION SYSTEM AND A METHOD OF OPERATION THEREOF

CROSS-REFERENCE TO RELATED APPLICATION

This patent application claims the benefit of U.S. Provisional Patent Application No. 63/508,976, filed on Jun. 19, 2023, which is incorporated by reference herein in its entirety.

BACKGROUND

This invention relates to the field of liquid desiccant dedicated vapor compression systems.

Vapor compression systems may be combined with a liquid desiccant dehumidification system to provide cool and dehumidified air in a space. The vapor compression system may cool the air and a dehumidifier (absorber) associated with the dehumidification system may involve a liquid desiccant to dehumidify the cooled air, which may then be supplied to the space. Further, the desiccant after dehumidifying the air may be regenerated using a desiccant regenerator (desorber). However, there is a need to further improve, enhance and make the vapor compression, dehumidification, and desiccant regeneration processes efficient, space-saving, and cost-effective.

SUMMARY

Described herein is a liquid desiccant dedicated vapor compression system. The system comprises an evaporator fluidically connected to a condenser through a compressor and an absorber fluidically connected to the evaporator to facilitate flow of air through the evaporator and the absorber, wherein an inlet of a first refrigerant tube associated with the absorber, and an inlet of evaporator coils associated with the evaporator are fluidically connected to an outlet of the condenser via one or more expansion valves.

In one or more embodiments, the one or more expansion valves comprise a first expansion valve fluidically connected between the condenser and the first refrigerant tube of the absorber, wherein the first expansion valve is configured to receive the refrigerant from the condenser or a receiver, and correspondingly expand and supply the refrigerant of a first pressure and a first temperature to the absorber, and a second expansion valve fluidically connected between the condenser and the evaporator, wherein the second expansion valve is configured to receive the refrigerant from the condenser or the receiver, and correspondingly expand and supply the refrigerant of a second pressure and a second temperature to the evaporator; and wherein the first pressure is less than the second pressure, and the first temperature is less than the second temperature.

In one or more embodiments, the evaporator is configured to facilitate the exchange of heat between the air and the refrigerant received from the condenser to cool the air, and correspondingly supply the cooled air to the absorber and further supply a warm refrigerant to the compressor.

In one or more embodiments, the absorber is configured to facilitate the flow of a concentrated desiccant solution therethrough to allow the concentrated desiccant solution to absorb moisture from the cool air received from the evaporator, and wherein the first refrigerant tube of the absorber is configured to facilitate the flow of the refrigerant, received from the condenser, through the absorber to cool the received air and the desiccant solution while the desiccant solution is absorbing the moisture from the air.

In one or more embodiments, the system comprises a desorber fluidically connected to the absorber by a liquid desiccant unit to facilitate the flow of the desiccant solution therebetween and further fluidically connected to the condenser to facilitate the flow of air through the condenser and the desorber, wherein an inlet of a second refrigerant tube associated with the desorber and an inlet of condenser coils associated with the condenser is fluidically connected to an outlet of the compressor.

In one or more embodiments, the compressor is configured to receive the warm refrigerant from the evaporator and the absorber and correspondingly supply a compressed refrigerant to one or more of the second refrigerant tube of the desorber and the condenser coil of the condenser.

In one or more embodiments, the condenser is configured to facilitate the exchange of heat between the air and the compressed refrigerant received from the compressor to heat the air, and correspondingly supply the heated air to the desorber and further supply a cool refrigerant to one or more of the evaporator and the absorber.

In one or more embodiments, the desorber is configured to facilitate the flow of a diluted desiccant solution therethrough to allow the heated air, received from the condenser, to absorb moisture from the diluted desiccant and regenerate a concentrated desiccant solution, and wherein the second refrigerant tube is configured to facilitate the flow of the compressed refrigerant received from the compressor to heat the diluted desiccant and facilitate the regeneration of the concentrated desiccant solution.

In one or more embodiments, the liquid desiccant unit is configured to facilitate the supply of the concentrated desiccant solution from the desorber to the absorber via a desiccant receiver, and the diluted desiccant solution from the absorber to the desorber via a desiccant pump.

In one or more embodiments, the absorber comprises a corrosion-resistant thermally conductive material, wherein the first refrigerant tube associated with the absorber is in thermal contact with and at least partially extending through the packing material.

In one or more embodiments, the desorber comprises a corrosion-resistant thermally conductive material, wherein the second refrigerant tube associated with the desorber is in thermal contact with and at least partially extending through the packing material.

Further described herein is a heat and mass exchange device. The device comprises an enclosure at least partially filled with a thermally conductive packing material, wherein the enclosure is adapted to facilitate flow of air through the packing material; and a refrigerant tube of a predefined arrangement disposed of within the packing material, wherein the refrigerant tube is adapted to be fluidically connected to one or more of: an outlet of a condenser or a precooler by a first expansion valve, and an outlet of a compressor associated with a liquid desiccant dedicated vapor compression system, wherein an outlet of the condenser is fluidically connected to an inlet of an evaporator of the vapor compression system by a second expansion valve, wherein the refrigerant tube is configured to facilitate flow of a refrigerant, received from the condenser or the compressor, therethrough; wherein the device is configured to facilitate flow of a desiccant solution through the packing material to facilitate exchange of heat and moisture between the air and the desiccant solution while flowing through the packing material, and wherein the refrigerant flowing through the tube facilitates heat exchange between the refrigerant and one or more of the desiccant solution, and the air, to control the temperature of the air flowing through the device.

In one or more embodiments, the device is an absorber. The device is configured to facilitate flow of a concentrated desiccant solution through the packing material to allow the desiccant solution to absorb moisture from the air while flowing through the packing material, and wherein the refrigerant tube is configured to facilitate flow of a cool refrigerant therethrough to cool the air and the desiccant solution flowing through the absorber while the desiccant solution is absorbing the moisture from the air.

In one or more embodiments, the device is a desorber. The device is configured to facilitate flow of a diluted desiccant solution through the packing material to allow the air to desorb moisture from the diluted desiccant and correspondingly regenerate a concentrated desiccant solution, and wherein the refrigerant tube is configured to facilitate flow of a compressed refrigerant therethrough to heat the diluted desiccant and facilitate the regeneration of the concentrated desiccant solution.

Also described herein is a method of conditioning air in a vapor compression system comprising an evaporator fluidically connected to a condenser through a compressor. The method comprises the steps of fluidically connecting an absorber to the evaporator to facilitate flow of air through the evaporator and the absorber, fluidically connecting an inlet of a first refrigerant tube associated with the absorber to an outlet of the condenser by a first expansion valve, and fluidically connecting an inlet of evaporator coils associated with the evaporator to the outlet of the condenser by a second expansion valve.

In one or more embodiments, the method comprises the steps of supplying a cool refrigerant from the outlet of the condenser to one or more of the first refrigerant tube of the absorber, and the evaporator coil of the evaporator, facilitating, by the evaporator, the exchange of heat between the air and the cool refrigerant received from the condenser to cool the air and correspondingly provide a warm refrigerant, and supplying the cooled air to the absorber and further supplying the warm refrigerant to the compressor.

In one or more embodiments, the method comprises the steps of facilitating flow of a concentrated desiccant solution through the absorber to allow the concentrated desiccant solution to absorb moisture from the cool air received from the evaporator, and facilitating the flow of the cool refrigerant, received from the condenser, through the absorber to cool the received air and the desiccant solution while the desiccant solution is absorbing the moisture from the air.

In one or more embodiments, the method comprises the steps of fluidically connecting a desorber to the absorber by a liquid desiccant unit to facilitate the flow of the desiccant solution therebetween and further fluidically connecting the desorber to the condenser to facilitate the flow of air through the condenser and the desorber, and fluidically connecting an inlet of a second refrigerant tube associated with the desorber and an inlet of condenser coils associated with the condenser to an outlet of the compressor.

In one or more embodiments, the method comprises the steps of receiving, by the compressor, the warm refrigerant from the evaporator and correspondingly supplying a compressed refrigerant to one or more of the second tube of the desorber and a condenser coil of the condenser, facilitating the exchange of heat between the air and the compressed refrigerant received from the compressor to heat the air, and correspondingly provide a cool refrigerant, and supplying the heated air to the desorber and further supplying the cool refrigerant to one or more of the evaporator, and the absorber.

In one or more embodiments, the method comprises the steps of facilitating the flow of a diluted desiccant solution through the desorber to allow the heated air, received from the condenser, to desorb moisture from the diluted desiccant and regenerate a concentrated desiccant solution, and facilitating the flow of the compressed refrigerant received from the compressor to heat the diluted desiccant and facilitate the regeneration of the concentrated desiccant solution.

The foregoing summary is illustrative only and is not intended to be in any way limiting. In addition to the illustrative aspects, embodiments, and features described above, further aspects, embodiments, features, and techniques of the invention will become more apparent from the following description taken in conjunction with the drawings.

BRIEF DESCRIPTION OF THE DRAWINGS

The accompanying drawings are included to provide a further understanding of the subject disclosure of this invention and are incorporated in and constitute a part of this specification. The drawings illustrate exemplary embodiments of the subject disclosure and, together with the description, serve to explain the principles of the subject disclosure.

In the drawings, similar components and/or features may have the same reference label. Further, various components of the same type may be distinguished by following the reference label with a second label that distinguishes among the similar components. If only the first reference label is used in the specification, the description applies to any one of the similar components having the same first reference label irrespective of the second reference label.

DETAILED DESCRIPTION

Figure 1:
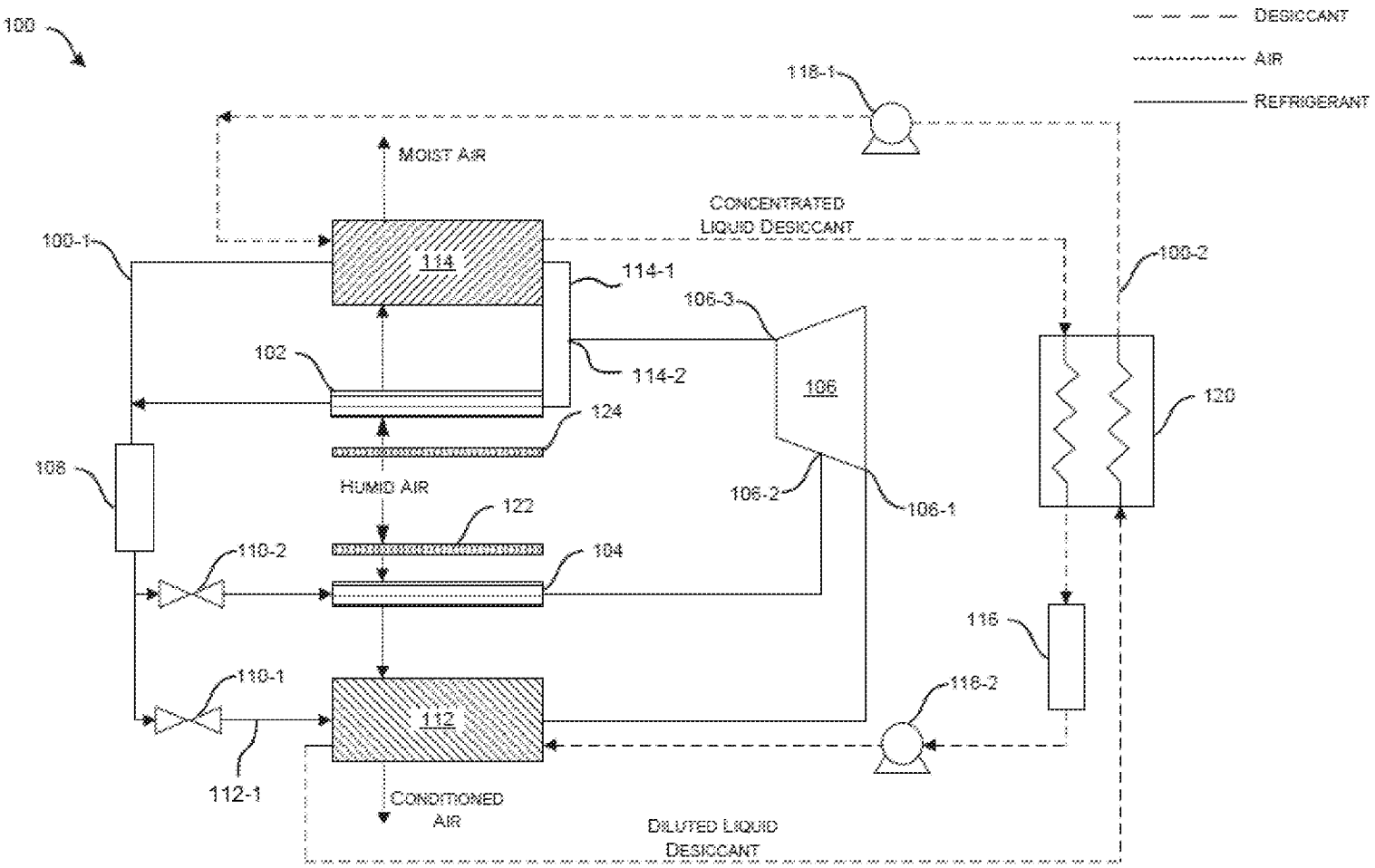
FIG. 1 illustrates an exemplary block diagrams of the liquid desiccant dedicated vapor compression system, in accordance with one or more embodiments of the disclosure.

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within the spirit and scope of the subject disclosure as defined by the appended claims.

Various terms are used herein. To the extent a term used in a claim is not defined below, it should be given the broadest definition persons in the pertinent art have given that term as reflected in printed publications and issued patents at the time of filing.

In the specification, reference may be made to the spatial relationships between various components and to the spatial orientation of various aspects of components as the devices are depicted in the attached drawings. However, as will be recognized by those skilled in the art after a complete reading of the subject disclosure, the components of this invention. described herein may be positioned in any desired orientation. Thus, the use of terms such as "above," "below," "upper," "lower," "first", "second" or other like terms to describe a spatial relationship between various components or to describe the spatial orientation of aspects of such components should be understood to describe a relative relationship between the components or a spatial orientation of aspects of such components, described herein may be oriented in any desired direction.

In a liquid desiccant dedicated vapor compression system, the vapor compression system may be combined with a liquid desiccant-based dehumidification system to supply cool and dehumidified air into a space. The vapor compression system may include a refrigerant circuit comprising a condenser fluidically connected to an evaporator via a compressor that circulates the refrigerant through the refrigerant circuit. Further, an expansion valve may expand and cool the refrigerant that may be used by the evaporator to facilitate heat exchange between the cool refrigerant and ambient air (or return air) to cool the air which may then be supplied to the space. The liquid desiccant-based dehumidification system may include a dehumidifier (absorber) that may involve a concentrated liquid desiccant solution that may exchange heat with the cool air (cooled at the evaporator) to dehumidify the cooled air before being supplied to the space. This dehumidification process may lead to the dehumidification of the cool air received from the evaporator, resulting in the generation of a diluted and warm desiccant. The liquid desiccant-based dehumidification system may further involve a desiccant regenerator (desorber) that may convert the diluted and warm desiccant into the concentrated desiccant solution. The desorber may receive the diluted desiccant from the absorber and may further facilitate heat exchange between ambient air (or return air) and the diluted desiccant to facilitate regeneration of the concentrated desiccant solution, which may then be supplied back to the absorber. However, there is a need to further improve, enhance (intensify), and make the vapor compression process, dehumidification process, and desiccant regeneration process efficient, space-saving, and cost-effective.

Existing absorbers or desorbers (also referred to as heat and mass exchange devices) may include a packing material having a low thermal conductivity where a thin film of liquid desiccant may descend along the packing material. At the absorber, air to be dehumidified may be passed through the desiccant-wetted packing material to dehumidify the air, resulting in the generation of the diluted desiccant. Further, at the desorber, the regeneration of the liquid desiccant may also be achieved in a similar fashion by using cool ambient air that may condense the diluted desiccant while flowing through the packing material. However, the packing material employed in the existing absorber or desorber may be thermally inefficient which may occupy a lot of volume and may also cause a pressure drop in the circuit. Moreover, there is a need to enhance heat transfer at the absorber and the desorber, and further intensify the dehumidification process at the absorber as well as the desiccant regeneration process at the desorber in the existing liquid desiccant dedicated vapor compressor systems.

This invention provides a system, a heat and mass exchange device, and a method of conditioning air in a vapor compression system, which improves, enhances, and makes the vapor compression, dehumidification, and desiccant regeneration processes efficient, space-saving, and cost-effective.

Referring to FIG. 1, the liquid desiccant dedicated vapor compression system "system" 100 is disclosed. The system 100 may include a refrigerant circuit 100-1 comprising a condenser 102, an evaporator 104, a compressor 106, a receiver 108, and one or more expansion valves 110-1, 110-2. Further, the system 100 may include a desiccant circuit 100-2 comprising an absorber 112 (also referred to as a dehumidifier, herein) that may be fluidically connected to the evaporator 104. The system 100 may further include a desorber 114 (also referred to as a regenerator, herein) that may be fluidically coupled to the absorber 112 and further fluidically connected to the condenser 102. The absorber 112 and the desorber 114 may be associated with the refrigerant circuit 100-1 as well as the desiccant circuit 100-2, which may allow heat exchange between the desiccant liquid, the air, as well as the refrigerant received from the refrigerant circuit 100-1 to intensify the air dehumidification and desiccant regeneration processes. The detailed construction of the absorber 112 and the desorber 114 (collectively designated as a heat and mass exchange device 200, 300, herein) has been described in conjunction with FIGS. 2 and 3

The absorber 112 may be fluidically connected to the evaporator 104 such that air (ambient air and/or return air from a space being cooled) may flow from the evaporator 104 to the absorber 112. Further, an inlet of a refrigerant tube 112-1 (first refrigerant tube or first tube) associated with the absorber 112, and an inlet of evaporator coils associated with the evaporator 104 may be fluidically connected to an outlet of the condenser 102 via the one or more expansion valve 110-1, 110-2. The system 100 may be configured to supply cool refrigerant from the outlet of the condenser 102 to the absorber 112, and/or evaporator coils of the evaporator 104.

In one or more embodiments, a first expansion valve 110-1 may be fluidically connected between the condenser 102 and the first refrigerant tube 112-1 of the absorber 112. The first expansion valve 110-1 may be configured to receive the refrigerant from the condenser 102 or receiver 108, and further expand and supply the refrigerant of a first pressure and a first temperature to the absorber 112. Further, a second expansion valve 110-2 may be fluidically connected between the condenser 102 and the evaporator 104. The second expansion valve 110-2 may be configured to receive the refrigerant from the condenser 102 or the receiver 108, and further expand and supply the refrigerant of a second pressure (higher than the first pressure) and a second temperature (higher than the first temperature) to the evaporator 104.

As the two expansion valves 110-1, 110-2 allow the refrigerant to expand to two different pressure and temperature levels based on the refrigerant temperature and pressure requirement of the absorber 112 and the evaporator 104, the energy consumption of the overall system 100 may be reduced. The refrigerant passing through the evaporator 104 after expansion by the second expansion valve 110-2 may need not be as cold (compared to refrigerant passing through the absorber 112) which may remain at an intermediate pressure level where it may be injected in the intermediate vapor injection port 106-2 of the compressor 106. Moreover, the refrigerant passing through the absorber 112 after expansion by the first expansion valve 110-1 may be at a lower pressure and lower temperature to improve heat transfer in the absorber 112. The lower-pressure refrigerant from the absorber 112 may be injected into a low suction port 106-1 of the compressor 106. As a result, smaller-size absorber 112 may be employed in the system 100, thereby making the system 100 compact, efficient, and cost-effective.

The compressor 106 may compress the refrigerant vapor and raise its pressure and temperature. The condenser 102 may be a heat exchanger that may receive the high-pressure, high-temperature refrigerant vapor from the outlet 106-3 of the compressor 106 and may cool the refrigerant down by exchanging heat with ambient cool air, causing the refrigerant to condense into a high-pressure liquid. The heat released during this process may be transferred to the surrounding air and/or the desorber 114. The expansion valves 110-1, 110-2 may be throttling device that may reduce the pressure and temperature of the refrigerant to a predetermined temperature (first and second temperatures) and predetermined pressure (first and second pressure) before it enters the evaporator 104 and/or the absorber 112. This may cause some of the refrigerant to vaporize and lowers the temperature of the fluid before being supplied to the evaporator 104 and/or the absorber 112.

The evaporator 104 may also be a heat exchanger that may absorb heat from the surrounding air (ambient air or return air from the space being cooled), causing the refrigerant to evaporate into a low-pressure refrigerant vapor. The evaporator 104 may facilitate the heat exchange between the air and the refrigerant received from the second expansion valve 110-2 to cool the air, and correspondingly supply the cooled air to the absorber 112 and further supply the low-pressure refrigerant vapor to the compressor 106 for further compression. In one or more embodiments, a first injection port 106-2 (also referred to as the intermediate pressure injection port) of the compressor 106 may be configured to receive the refrigerant from the evaporator 104, and a second injection port 106-1 (also referred to as the lower suction pressure port) of the compressor 106 may be configured to receive the warm refrigerant from the absorber 112.

The absorber 112 may be configured to facilitate the flow of a concentrated desiccant solution therethrough to allow the concentrated desiccant solution to absorb moisture from the cool air received from the evaporator 104. The first refrigerant tube 112-1 of the absorber 112 may be configured to facilitate the flow of the refrigerant, received from the first expansion valve 110-1, through the absorber 112 which may enhance or intensify the cooling of the received air while the desiccant solution is absorbing the moisture from the air. Accordingly, the absorber 112 and the evaporator 104 may supply cool and dehumidified air to the space.

The desorber 114 may be fluidically connected to the absorber 112 by a liquid desiccant pumping system (118-1, 118-2) to facilitate the flow of the desiccant solution therebetween. The desorber 114 may be further fluidically connected to the condenser 102 such that air (heated air) may flow from the condenser 102 to the desorber 114. Further, an inlet of a refrigerant tube 114-2 (second refrigerant tube or second tube) associated with the desorber 114 and an inlet of condenser 102 coils associated with the condenser 102 may be fluidically connected to an outlet or ejection port 106-3 of the compressor 106 by two separate conduits.

The compressor 106 may compress the refrigerant vapor received from the evaporator 104 and/or the absorber 112, thereby raising the pressure and temperature of the refrigerant. The system 100 may be configured to supply the compressed refrigerant to one or more of the second refrigerant tube 114-1 of the desorber 114 and the condenser coils of the condenser 102 via two separate conduits. The condenser 102 may receive the high-pressure, high-temperature refrigerant vapor from the compressor 106 and facilitate heat exchange between the air and the received refrigerant which may heat the air causing the refrigerant to condense into a high-pressure liquid that may be supplied to the receiver 108, and further supplying the heated air to the desorber 114.

The desorber 114 may be configured to facilitate the flow of the diluted desiccant solution (received from the absorber 112) therethrough. The desorber 114 may further allow the heated air (received from the condenser 102) to desorb moisture from the diluted desiccant and regenerate the concentrated desiccant solution. During the desiccant regeneration process, the desorber 114 may allow the flow of the compressed heated refrigerant (received from the compressor 106) therethrough to heat the diluted desiccant which may further enhance or intensify the regeneration of the concentrated desiccant solution.

In one or more embodiments, the concentrated desiccant solution from the desorber 114 may be supplied to the absorber 112 via a desiccant receiver 116 (which may temporarily store the desiccant solution), and the diluted desiccant solution from the absorber 112 may be supplied to the desorber 114 via a first desiccant pump 118-1 and the regenerated concentrated desiccant liquid from the desorber 114 may be supplied to the absorber 112 via a second desiccant pump 118-2. Further, the desiccant circuit 100-2 can include a brazed-plate heat exchanger 120 to facilitate heat exchange between the diluted desiccant and the concentrated desiccant while circulating between the absorber 112 and the desorber 114. In addition, additional piping systems and valves may be used to connect the various components of the system 100 and control the flow of refrigerant through the refrigerant circuit 100-1 and the desiccant circuit 100-2. Overall, the components associated with the refrigerant circuit 100-1 may work together with the components of the desiccant circuit 100-2 to circulate the refrigerant through the vapor compression system 100 and further circulate the desiccant through the desiccant circuit 100-2 to cool and dehumidify the desired space.

In one or more embodiments, the system 100 may include a filter 122 positioned upstream of the evaporator 104 to filter the air (ambient air and/or return air) before being supplied through the evaporator 104 and the absorber 112. Further, the system 100 may include another filter 124 positioned upstream of the condenser 102 to filter the air (ambient air and/or return air) before being supplied through the condenser 102 and the desorber 114.

Figure 4:
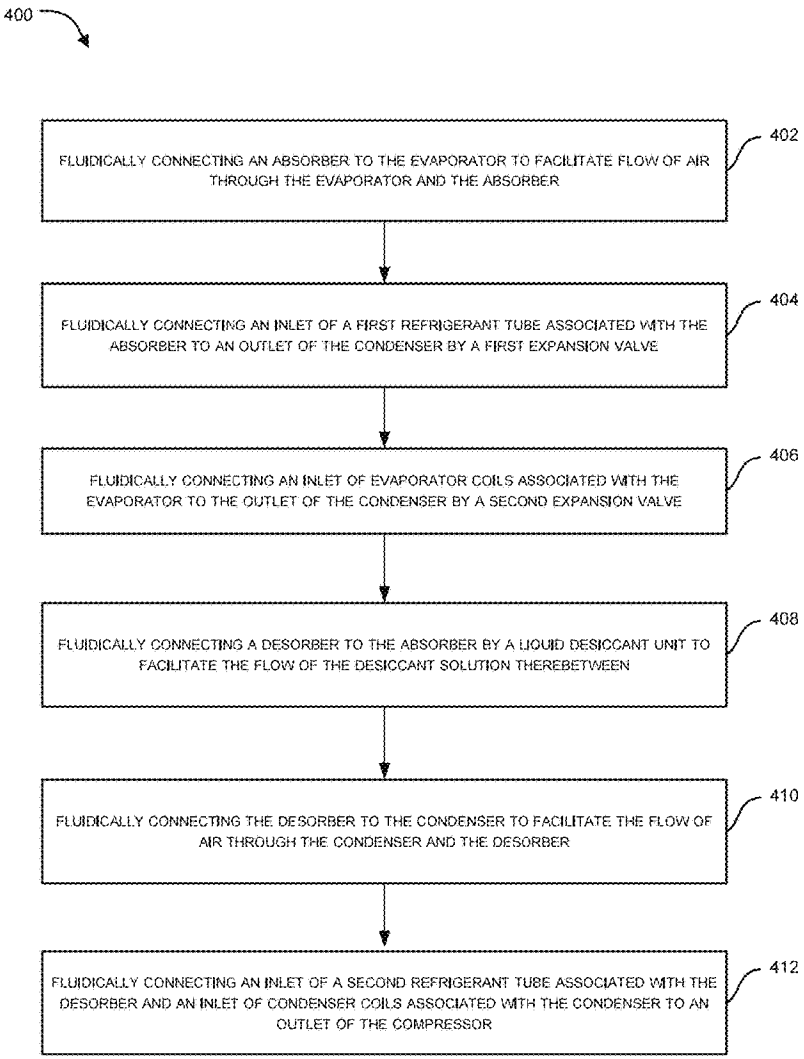
FIG. 4 illustrates an exemplary flow diagram of a method of conditioning air and controlling the operation of a vapor compression system, in accordance with one or more embodiments of the disclosure

Referring to FIG. 4, an exemplary flow diagram of a method 400 for conditioning air and controlling the operation of a vapor compression system is disclosed. Method 400 may involve the components associated with the system 100, where the vapor compressor system may be combined with the liquid desiccant-based dehumidification system as explained in detail in the above paragraphs. Method 400 may include step 402 of fluidically connecting an absorber of the dehumidification system to the evaporator or precooler of the vapor compression system such that air may flow from the evaporator to the absorber. Further, method 400 may include step 404 of fluidically connecting an inlet of a first refrigerant tube associated with the absorber to an outlet of the condenser of the vapor compression system by a first expansion valve. Furthermore, method 400 may include step 406 of fluidically connecting an inlet of evaporator coils associated with the evaporator to an outlet of the condenser by a second expansion valve and a refrigerant receiver.

In one or more embodiments, method 400 may include the step supplying a cool refrigerant from the outlet of the condenser to one or more of the first refrigerant tube of the absorber, and the evaporator coil of the evaporator by the corresponding expansion valves. Further, at the condenser, method 400 may include the steps of facilitating heat exchange between the air (ambient air or return air) and the cool refrigerant received from the second expansion valve to cool the air and correspondingly provide a warm refrigerant. The cool air may then be supplied to the absorber for dehumidification and the warm refrigerant from the evaporator may be supplied to an intermediate injection port of the compressor.

In one or more embodiments, method 400 may further include the step of facilitating the flow of a concentrated desiccant solution through the absorber to allow the concentrated desiccant solution to absorb moisture from the cool air received from the evaporator. In addition, method 400 may further include the steps of facilitating the flow of the cool refrigerant, received from the first expansion valve, through the absorber to cool the received air and the desiccant solution while the desiccant solution is absorbing the moisture from the air. Further, the warm refrigerant from the absorber may be supplied to the lower suction port of the compressor. This may help intensify the dehumidification of the air.

Method 400 may include step 408 of fluidically connecting a desorber to the absorber by a liquid desiccant unit in the desiccant circuit such that the desiccant solution may flow between the absorber and the desorber. Method 400 may further include step 410 of fluidically connecting the desorber of the dehumidification system to the condenser of the vapor compression system such that air may flow from the condenser to the desorber. Further, method 400 may include step 412 of fluidically connecting an inlet of a second refrigerant tube associated with the desorber and an inlet of condenser coils associated with the condenser to an outlet of the compressor.

In one or more embodiments, method 400 may include the step of receiving, by the compressor, the warm refrigerant from the evaporator. The compressor may correspondingly supply a compressed refrigerant to one or more of the second tube of the desorber and a condenser coil of the condenser. Method 400 may further include the step of facilitating the exchange of heat between the air and the compressed refrigerant received from the compressor to heat the air and correspondingly provide a cool refrigerant. The heated air may be supplied to the desorber and the cool refrigerant may be supplied to one or more of the evaporator, and the absorber.

In one or more embodiments, method 400 may include the step of facilitating the flow of a diluted desiccant solution through the desorber to allow the heated air (received from the condenser) to desorb moisture from the diluted desiccant and regenerate a concentrated desiccant solution. In addition, method 400 may further include the step of flowing the compressed refrigerant (received from the compressor) through the desorber to heat the diluted desiccant and facilitate the regeneration of the concentrated desiccant solution. This may intensify the desiccant regeneration process.

Figure 2:
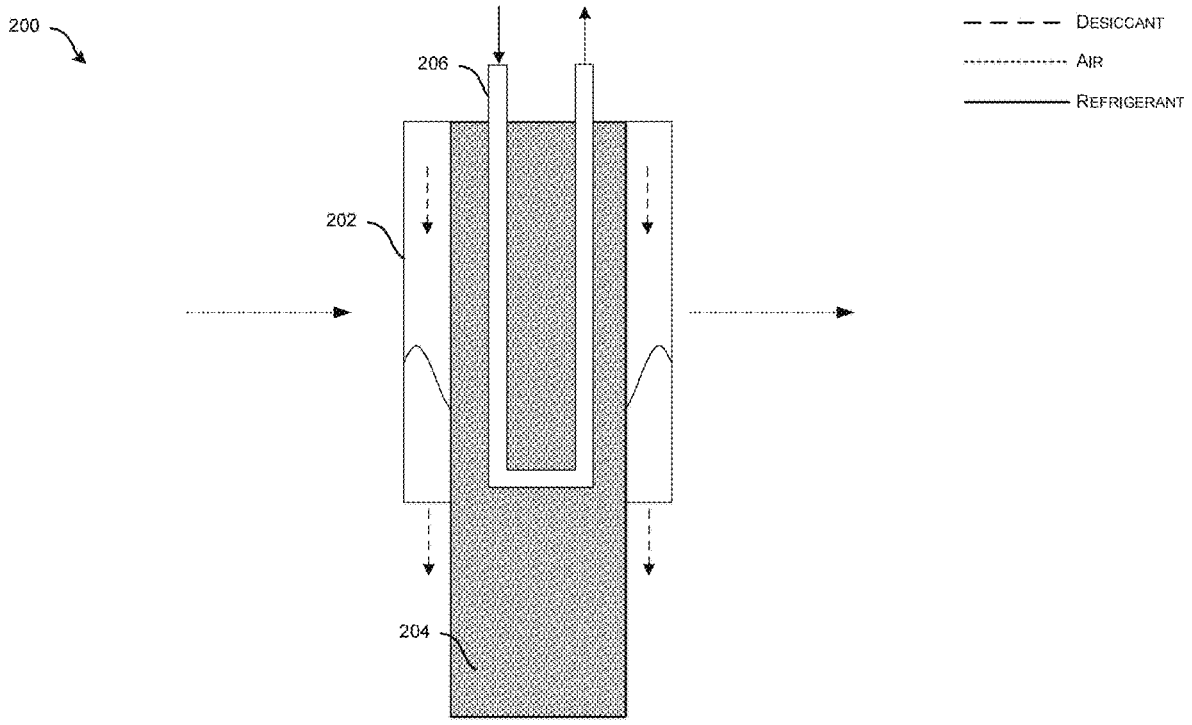
FIG. 2 illustrates an exemplary view of a first embodiment of the heat and mass transfer device implemented in the system of FIG. 1, in accordance with one or more embodiments of the disclosure.

Referring to FIG. 2, a first embodiment of the heat and mass transfer device (also referred to as device, herein) 200 implemented as the absorber 112 and the desorber 114 in the system of FIG. 1 is disclosed. The device may include an enclosure 202 at least partially filled with a corrosion-resistant thermally conductive packing material 204. The enclosure 202 may be adapted to facilitate the flow of air and a liquid desiccant through the packing material 204. The device 200 may further include a refrigerant tube 206 of a predefined arrangement disposed of within the packing material 204 such that an inlet and outlet of the tube 206 may be accessible from outside of the enclosure 202. For example, the tube 206 may have a predefined number of turns and passes, however, the tube 206 may also have other designs and configurations.

Referring to FIGS. 1 and 2, in one or more embodiments, when the device 200 is implemented as an absorber 112, the tube 112-1, 206 of the absorber 112/device 200 may be fluidically connected to an outlet of a condenser 102 by the first expansion valve 110-1 and a receiver 108. Further, the device 200/absorber 112 may be arranged downstream of the evaporator 104. Accordingly, the tube 112-1, 206 of the absorber 112/device 200 may facilitate the flow of a refrigerant, received from the condenser 102, through the packing material 204. In addition, the absorber 112 may receive cool air from the evaporator 104 which may flow through the packing material 204. Further, the concentrated liquid desiccant may flow from the top end to the bottom end of the packing material 204 under gravity to wet the packing material 204. Thus, the absorber 112/device 200 may allow the concentrated desiccant solution to absorb moisture from the cool air (received from the evaporator) while flowing through the packing material 204. Moreover, the cool refrigerant flowing through the tube 206 of the absorber 112 may further cool the air while the desiccant solution is absorbing the moisture from the air. This may help intensify the dehumidification of the air while keeping the air cool.

In one or more embodiments, when the device 200 is implemented as a desorber 114, the tube 114-1, 206 of the absorber 112/device 200 may be fluidically connected to an outlet 106-3 of the compressor 106. Further, the device 200/desorber 114 may be arranged downstream of the condenser 102. Accordingly, the tube 114-1, 206 of the desorber 114/device 200 may facilitate the flow of a refrigerant, received from the compressor, through the packing material 204. In addition, the desorber 114 may receive warm air from the condenser 102 which may flow through the packing material 204. Further, the diluted desiccant received from the absorber 112 may flow from the top end to the bottom end of the packing material 204 under gravity. Thus, the desorber 114/device 200 may allow the heated air (received from the condenser) to desorb moisture from the diluted desiccant while flowing through the packing material 204 to correspondingly regenerate a concentrated desiccant solution. Moreover, the compressed refrigerant (received from the compressor) flowing through the tube 206 of desorber 114 may heat the diluted desiccant and facilitate the regeneration of the concentrated desiccant solution. This may intensify the desiccant regeneration process.

Figure 3:
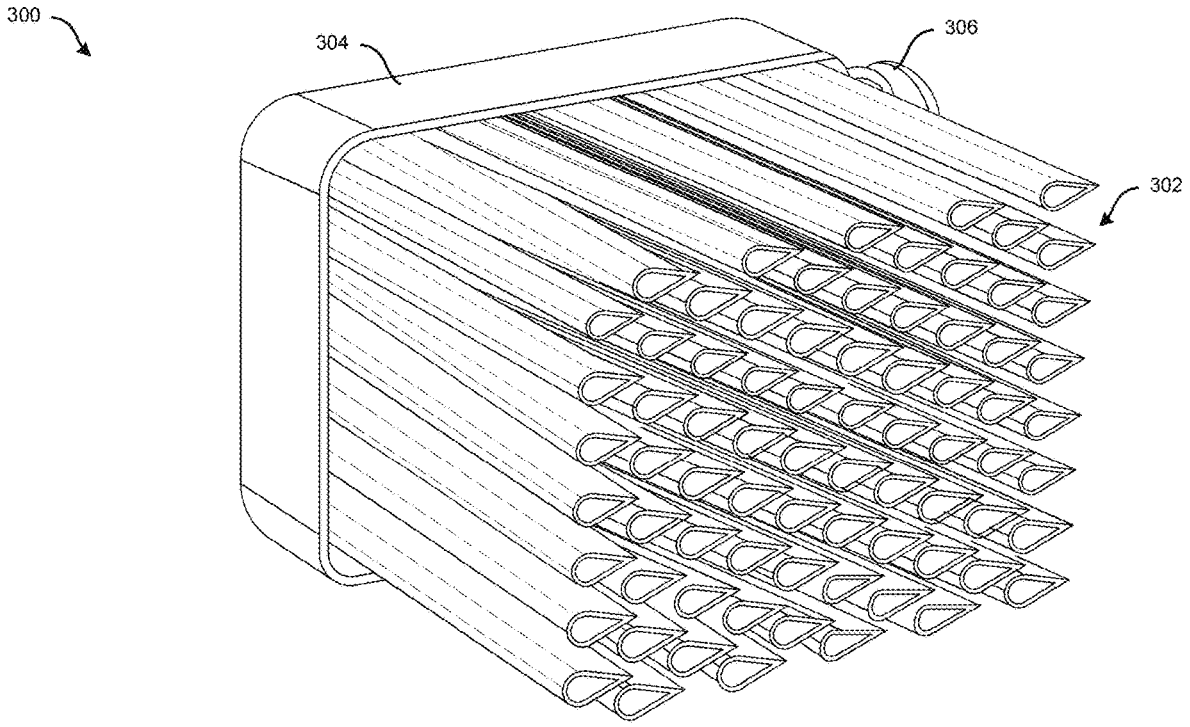
FIG. 3 illustrates an exemplary view of a second embodiment of the heat and mass transfer device implemented in the system of FIG. 1, in accordance with one or more embodiments of the disclosure.

Referring to FIG. 3, a second embodiment of the heat and mass transfer device "device" 300 implemented as the absorber and the desorber in the system of FIG. 1 is disclosed. The device 300 may include a matrix of tubes 302 of predefined length extending from a common housing 304. The tubes 302 may have a teardrop shape arranged in the matrix in parallel relation in rows in which each tube may have a rounded surface at one end and a tapered narrow surface at the other end. Further, the tubes 302 in each row may face the same direction, however, the tubes 302 of alternate rows may be in opposite directions as well. The device 300 may allow a refrigerant to flow in the tubes 302 through an inlet 306 of the housing 304, where the refrigerant may undergo heat exchange with a desiccant liquid flowing externally on the tubes 302. The refrigerant from the tubes 302 may flow to a header (not shown) where the refrigerant may be collected at an outlet of the header. The teardrop profile may further enhance the heat exchange between the desiccant flowing externally of the tubes 302 and the refrigerant flowing through the tubes 302. In one or more embodiments, the device 300 of FIG. 3 may be fabricated using additive manufacturing techniques.

Referring to FIGS. 1 and 3, in one or more embodiments, when the device 300 is implemented as an absorber 112, the housing 304 of the absorber 112 may be fluidically connected to an outlet of a condenser 102 by the first expansion valve 110-1 and a receiver 108. Further, the device 300/absorber 112 may be arranged downstream of the evaporator. Accordingly, the matrix of teardrop-shaped tubes 302 may facilitate the flow of a refrigerant received from the condenser 102. In addition, the absorber 112 may receive cool air from the evaporator 104 which may also flow across the tubes 302. Further, the concentrated liquid desiccant may flow externally along the tubes 302 due to the teardrop shape of the tubes 302. Thus, the absorber 112/device 300 may allow the concentrated desiccant solution to absorb moisture from the cool air (received from the evaporator). Moreover, the cool refrigerant flowing through the tubes 302 may further cool the air while the desiccant solution is absorbing the moisture from the air. This may help intensify the dehumidification of the air while keeping the air cool.

In one or more embodiments, when the device 300 is implemented as a desorber 114, the housing 304 of the absorber 112 may be fluidically connected to an inlet 106-1 of the compressor 106. Further, the device 300/desorber 114 may be arranged downstream of the condenser 102. Accordingly, the matrix of teardrop-shaped tubes 302 may facilitate the flow of refrigerant received from the compressor 106. In addition, the desorber 114 may receive warm air from the condenser 102 which may flow across the tubes 302. Further, the diluted liquid desiccant received from the absorber 112 may flow externally along the tubes 302 due to the teardrop shape of the tubes 302. Thus, the desorber 114/device 300 may allow the heated air (received from the condenser) to desorb moisture from the diluted desiccant to correspondingly regenerate a concentrated desiccant solution. Moreover, the compressed refrigerant (received from the compressor) flowing through the tubes 302 of desorber 114 may heat the diluted desiccant and facilitate the regeneration of the concentrated desiccant solution. This may intensify the desiccant regeneration process.

It is to be appreciated by a person skilled in the art that the supply of low-pressure and low-temperature refrigerant from the first expansion valve into the absorber may enhance or intensify the air dehumidification process at the absorber. In addition, the supply of compressed and heated refrigerant from the compressor into the desorber may enhance or intensify the overall desiccant regeneration process. Moreover, as the expansion valves allow the refrigerant to expand to two different pressure and temperature levels based on the refrigerant temperature and pressure requirement of the absorber and the evaporator, the energy consumption of the overall system may be reduced.

In addition, the refrigerant passing through the evaporator after expansion by the second expansion valve may need not be as cold (compared to refrigerant passing through the absorber) which may remain at an intermediate pressure level where it may be injected in the intermediate vapor injection port of the compressor. Moreover, the refrigerant passing through the absorber after expansion by the first expansion valve may be at a lower pressure and lower temperature to improve heat transfer in the absorber. As a result, smaller size absorber may be employed in the system, thereby making the system space-saving, efficient, and cost-effective Thus, this invention (system, device, and method) improves, enhances, and makes the vapor compression process, dehumidification process, and desiccant regeneration process efficient, space-saving, and cost-effective.

While the invention has been described with reference to exemplary embodiments, it will be understood by those skilled in the art that various changes may be made and equivalents may be substituted for elements thereof without departing from the scope of the invention as defined by the appended claims. Modifications may be made to adopt a particular situation or material to the teachings of the invention without departing from the scope thereof. Therefore, it is intended that the invention not be limited to the particular embodiment disclosed, but that the invention includes all embodiments falling within the scope of the invention as defined by the appended claims.

In interpreting the specification, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

The invention claimed is:

1. A liquid desiccant dedicated vapor compression system comprising:

an evaporator fluidically connected to a condenser through a compressor; and an absorber fluidically connected to the evaporator to facilitate flow of air through the evaporator and the absorber, wherein an inlet of a first refrigerant tube associated with the absorber, and an inlet of evaporator coils associated with the evaporator are fluidically connected to an outlet of the condenser via a plurality of expansion valves, wherein the plurality of expansion valves comprise:

a first expansion valve fluidically connected between the condenser and the first refrigerant tube of the absorber, wherein the first expansion valve is configured to receive the refrigerant from the condenser or a receiver, and correspondingly expand and supply the refrigerant of a first pressure and a first temperature to the absorber; and a second expansion valve fluidically connected between the condenser and the evaporator, wherein the second expansion valve is configured to receive the refrigerant from the condenser or the receiver, and correspondingly expand and supply the refrigerant of a second pressure and a second temperature to the evaporator.

2. The system of claim 1, wherein the plurality of expansion valves is configured such that the first pressure is less than the second pressure, and the first temperature is less than the second temperature.

3. The system of claim 1, wherein the evaporator is configured to:

facilitate the exchange of heat between the air and the refrigerant received from the condenser to cool the air, and correspondingly supply the cooled air to the absorber and further supply a warm refrigerant to the compressor.

4. The system of claim 1, wherein the absorber is configured to facilitate the flow of a concentrated desiccant solution therethrough to allow the concentrated desiccant solution to absorb moisture from the cool air received from the evaporator, and wherein the first refrigerant tube of the absorber is configured to facilitate the flow of the refrigerant, received from the condenser, through the absorber to cool the received air while the desiccant solution is absorbing the moisture from the air.

5. The system of claim 1, wherein the system comprises:

a desorber fluidically connected to the absorber by a liquid desiccant unit to facilitate the flow of the desiccant solution therebetween and further fluidically connected to the condenser to facilitate the flow of air through the condenser and the desorber, wherein an inlet of a second refrigerant tube associated with the desorber and an inlet of condenser coils associated with the condenser is fluidically connected to an outlet of the compressor.

6. The system of claim 5, wherein the compressor is configured to receive the warm refrigerant from the evaporator and the absorber and correspondingly supply a compressed refrigerant to one or more of the second refrigerant tube of the desorber and the condenser coil of the condenser.

7. The system of claim 6, wherein the condenser is configured to:

facilitate the exchange of heat between the air and the compressed refrigerant received from the compressor to heat the air, and correspondingly supply the heated air to the desorber and further supply a cool refrigerant to one or more of the evaporator and the absorber.

8. The system of claim 7, wherein the desorber is configured to facilitate the flow of a diluted desiccant solution therethrough to allow the heated air, received from the condenser, to desorb moisture from the diluted desiccant and regenerate a concentrated desiccant solution, and wherein the second refrigerant tube is configured to facilitate the flow of the compressed refrigerant received from the compressor to heat the diluted desiccant and facilitate the regeneration of the concentrated desiccant solution.

9. The system of claim 5, wherein the liquid desiccant unit is configured to facilitate the supply of:

the concentrated desiccant solution from the desorber to the absorber via a desiccant receiver; and the diluted desiccant solution from the absorber to the desorber via a desiccant pump.

10. The system of claim 1, wherein the absorber comprises a corrosion-resistant thermally conductive material, wherein the first refrigerant tube associated with the absorber is in thermal contact with and at least partially extending through a packing material.

11. The system of claim 5, wherein the desorber comprises a corrosion-resistant thermally conductive material, wherein the second refrigerant tube associated with the desorber is in thermal contact with and at least partially extending through a packing material.

12. A liquid desiccant dedicated vapor compression system comprising:

an evaporator fluidically connected to a condenser through a compressor; and an absorber fluidically connected to the evaporator to facilitate flow of air through the evaporator and the absorber, wherein an inlet of a first refrigerant tube associated with the absorber, an inlet of evaporator coils associated with the evaporator are fluidically connected to an outlet of the condenser via one or more expansion valves, and wherein an outlet of the absorber is fluidically connected to a suction port of the compressor, and an outlet of the evaporator is fluidically connected to an injection port of the compressor.

13. A method of conditioning air in a vapor compression system including the liquid desiccant dedicated vapor compression system according to claim 1, the method comprising:

facilitating the flow of a diluted desiccant solution through the desorber to allow the heated air, received from the condenser, to desorb moisture form the diluted desiccant and regenerate a concentrated desiccant solution; and/or facilitating the flow of the compressed refrigerant received from the compressor to heat the diluted desiccant and facilitate the regeneration of the concentrated desiccant solution.

14. A method of conditioning air in a vapor compression system including the liquid desiccant dedicated vapor compression system according to claim 12, the method comprising:

facilitating the flow of a diluted desiccant solution through the desorber to allow the heated air, received from the condenser, to desorb moisture form the diluted desiccant and regenerate a concentrated desiccant solution; and/or facilitating the flow of the compressed refrigerant received from the compressor to heat the diluted desiccant and facilitate the regeneration of the concentrated desiccant solution.

* * * * *